US007399103B2

(12) United States Patent
Lin

(10) Patent No.: US 7,399,103 B2
(45) Date of Patent: Jul. 15, 2008

(54) ROTATABLE POWER SUPPLY APPARATUS

(76) Inventor: Fong-Shi Lin, 2F-1, No. 152, Nan Yar Street, Hsinchu City (TW)

( * ) Notice: Subject to any disclaimer, the term of this patent is extended or adjusted under 35 U.S.C. 154(b) by 163 days.

(21) Appl. No.: 11/507,433

(22) Filed: Aug. 22, 2006

(65) Prior Publication Data

US 2008/0049425 A1 Feb. 28, 2008

(51) Int. Cl.
*F21S 13/14* (2006.01)

(52) U.S. Cl. ..... 362/252; 362/122; 362/565; 362/806; 439/20

(58) Field of Classification Search ..... 362/565, 362/253, 568, 605, 122, 644, 653, 806, 249, 362/252; 248/522, 521; 439/20, 21–23, 439/18, 25–28
See application file for complete search history.

(56) References Cited

U.S. PATENT DOCUMENTS 1,971,300 A * 8/1934 Garrett ..... 248/522
1,988,343 A * 1/1935 Tacy ..... 248/522
3,723,723 A * 3/1973 Lerner ..... 362/251
4,029,954 A * 6/1977 Moyer ..... 362/183
5,082,422 A * 1/1992 Wang ..... 416/5
5,517,388 A * 5/1996 Hutchisson ..... 362/35
5,647,569 A * 7/1997 Sofy ..... 248/522
6,494,595 B1 * 12/2002 Lin ..... 362/250
7,033,035 B2 * 4/2006 Fatemi et al. ..... 362/35
7,311,421 B1 * 12/2007 Fahl ..... 362/250

* cited by examiner

*Primary Examiner*—Sandra L. O'Shea
*Assistant Examiner*—Gunyoung T. Lee
(74) *Attorney, Agent, or Firm*—Rosenberg, Klein & Lee

(57) ABSTRACT

The invention relates to a rotatable power supply apparatus, which includes a shell and a cap for receiving an inner power supply. The apparatus also includes a connector and a cover for connecting any ornament with light string. The apparatus can provide power for the lighting ornament and rotates the ornament at the same time easily that obtains a utilized beautiful rotating decoration.

2 Claims, 5 Drawing Sheets

ROTATABLE POWER SUPPLY APPARATUS

BACKGROUND OF THE INVENTION

It is known to use some lighting ornaments for providing a beautiful indoor dressing. The conventional ornament usually includes a light string as the lighting means, which has an electrical wire connecting with many bulb assemblies. Because of the used light string, the known ornament cannot be a rotary one, since the electrical wire will be winded. Hence, the conventional lighting ornaments are almost static and cannot be rotated. It is a drawback to be improved.

SUMMARY OF THE INVENTION

It is an object of the present invention to provide a rotatable power supply apparatus for rotating a lighting ornament, which solves the problem of the prior art and obtains improvement and utilization. Now, accompanying with the following drawings, the character of the present invention will be described here and after.

DETAILED DESCRIPTION OF THE PREFERRED EMBODIMENT

Figure 1:
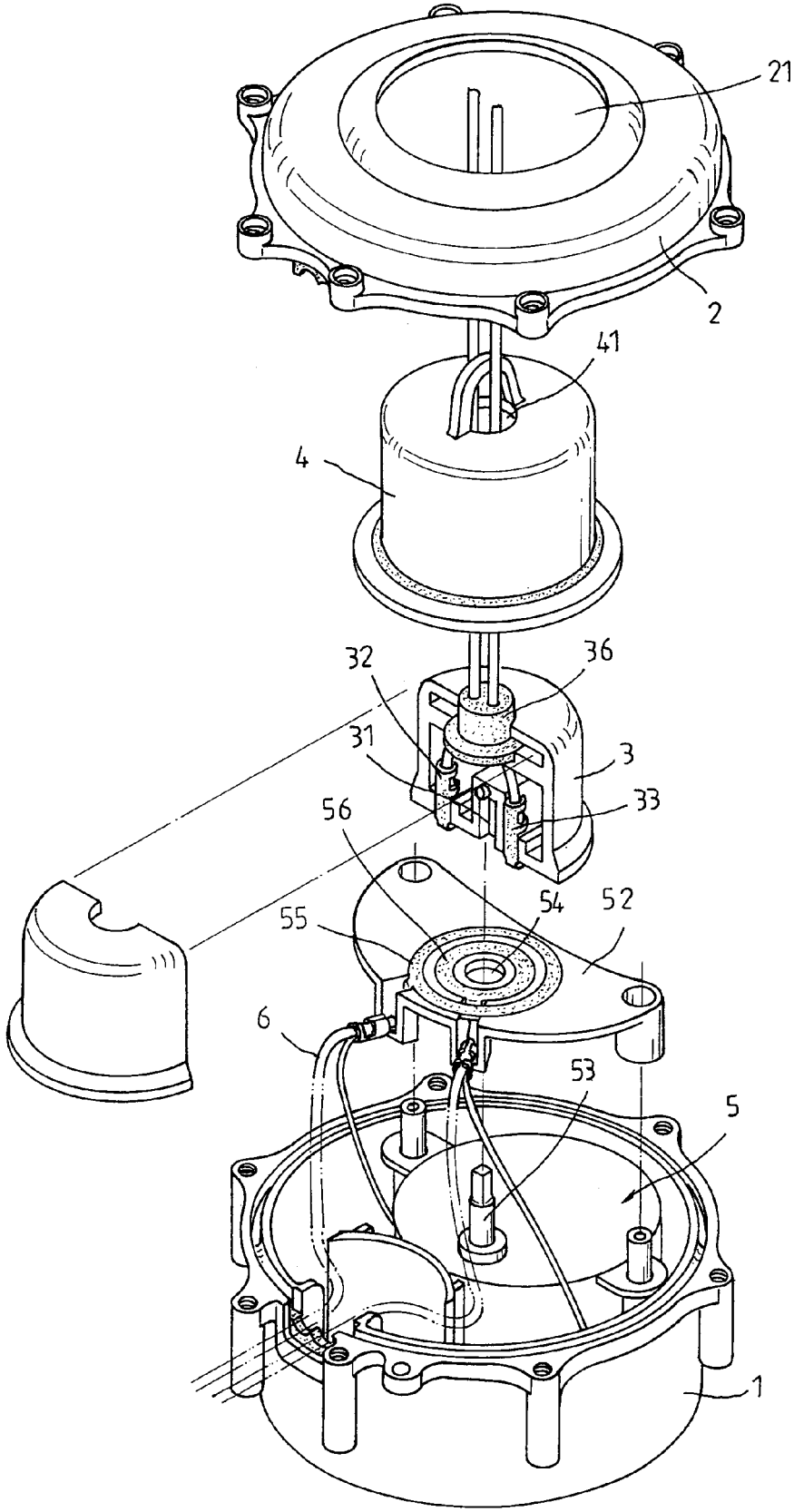
FIG. 1 is an exploded perspective view showing a rotatable power supply apparatus according to the present invention.
Figure 2:
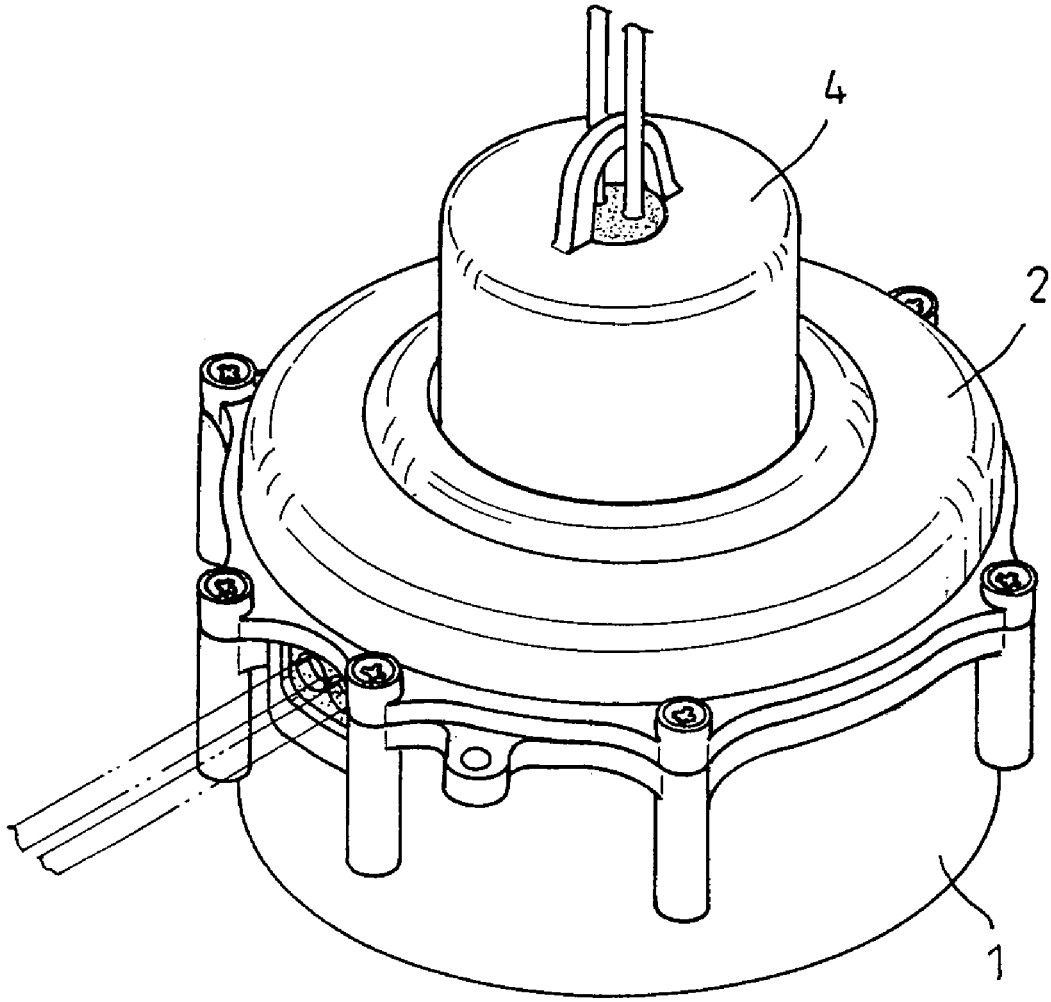
FIG. 2 is an assembled perspective view of FIG. 1.
Figure 3:
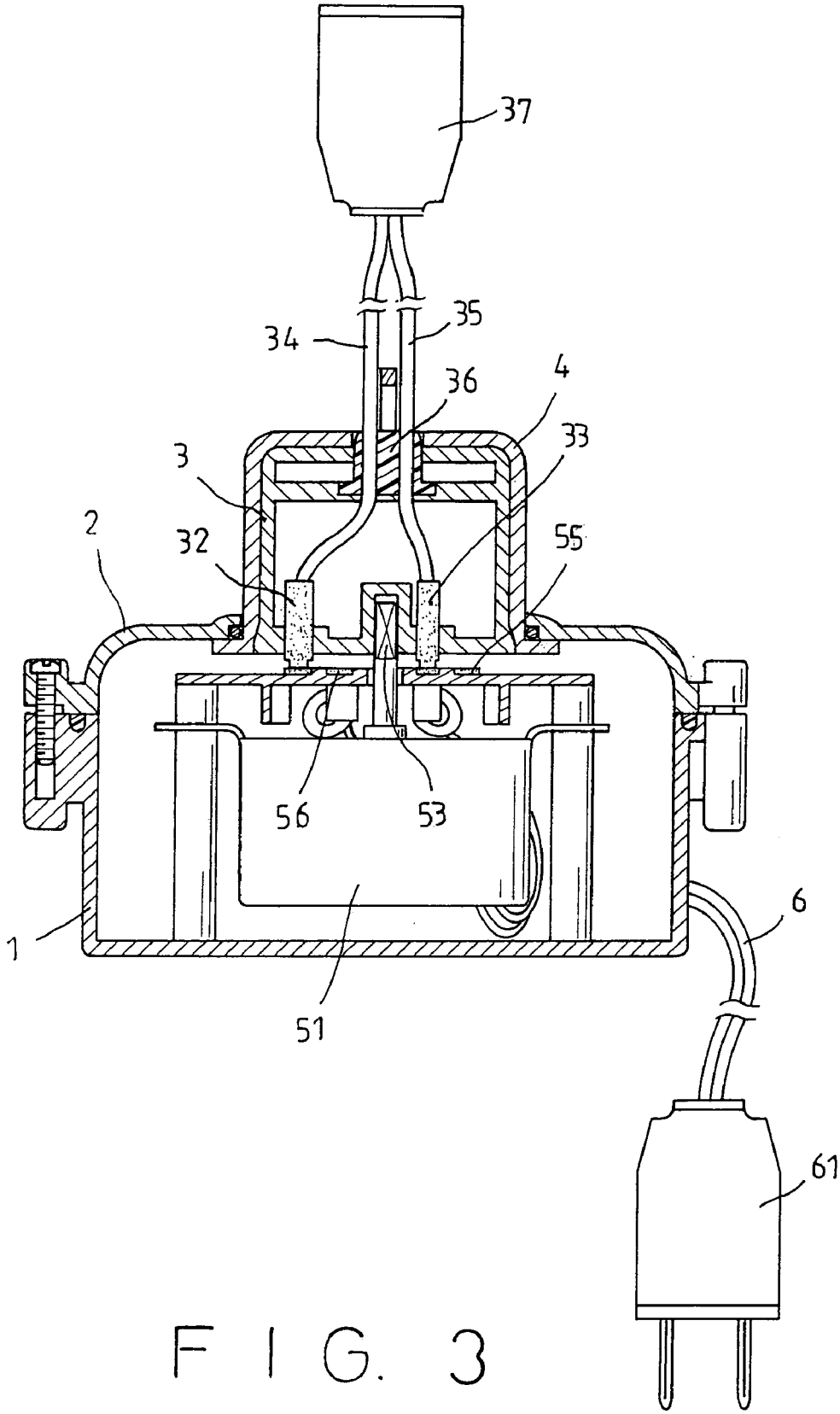
FIG. 3 is a cross-sectional plan view of FIG. 2.

Referring to FIGS. 1 to 3, the present invention includes a housing (1), a housing cap (2), a connecting rotor (3), and a rotor cover (4). A power supply (5) received in the housing (1) comprises a motor (51) and a frame (52), in which the motor (51) has its shaft (53) upward pass through an aperture (54) of the frame (52). The surface of the frame (52) is provided with an inner metal conducting circle (56) and an outer metal conducting circle (55), both of which connect to the motor (51) and a plug (61) by the wires (6).

The housing cap (2) mounted on the housing (1) has a central hole (21) for receiving the connecting rotor (3) and the rotor cover (4). The connecting rotor (3) has an inner shaft-joint (31) to engage with the shaft (53) of the motor (51) and has two downward metal, or electrical brush, pins (32), (33) to contact two metal conducting circles (55), (56) on the frame (52) respectively. The metal pins(32), (33) connect to electrical wires (34), (35) at upper ends, while the electrical wires (34), (35) are extended upward and penetrated through a rotor bushing (36) to be jointed and formed a socket (37). The rotor (36) is positioned at upper end of the connecting rotor (3) and received in a hole (41) of the rotor cover (4), which is placed outside the connecting rotor (3).

When the plug (61) connects to outer power source, the motor (51) begins rotating and then rotates to connecting rotor (3) and the rotor cover (4). At the time, two electrical brush pins (32), (33) rotates on two metal conducting circles (55), (56) without separation. As two metal conducting circles (55), (56) are electrified, the socket (37) becomes a power supply and is rotatable. Hence, the present invention becomes a rotatable power supply apparatus.

Figure 4:
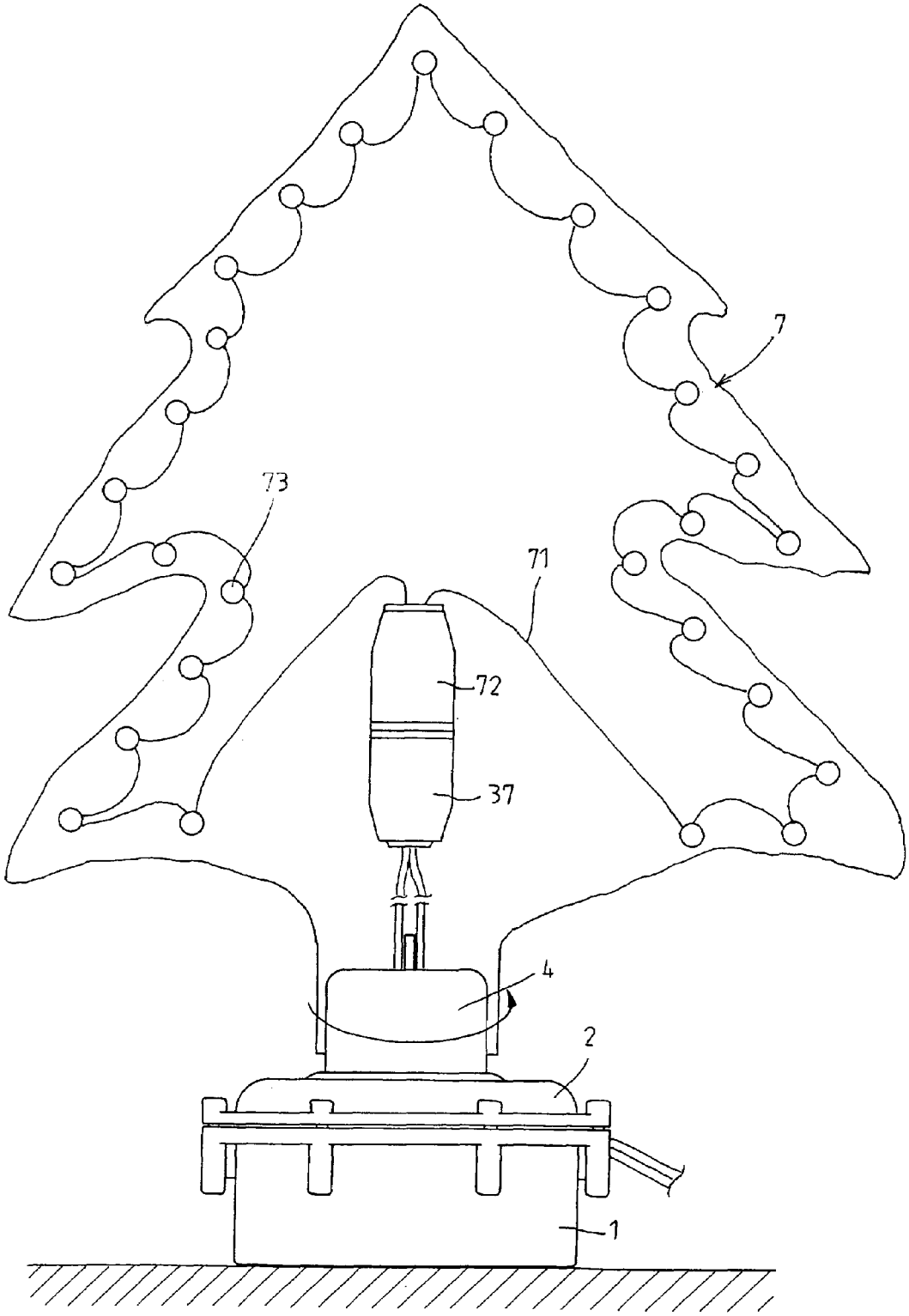
FIG. 4 is a plan view showing an embodiment connecting with a Christmas tree according to the present invention.

In application, FIG. 4 shows an embodiment, wherein a Christmas tree (7) is connected to the rotor cover (4) of the apparatus. A light string (71) winded on the tree has its plug (72) connect to the socket (37). When the plug (61) of the wire (6) is connected to an outside power source, the bulbs (73) of the Christmas tree (73) are lightened and the tree (7) is rotated followed the rotor cover (4). Thus, it reaches the effect of rotating and lighting at the same time.

Figure 5:
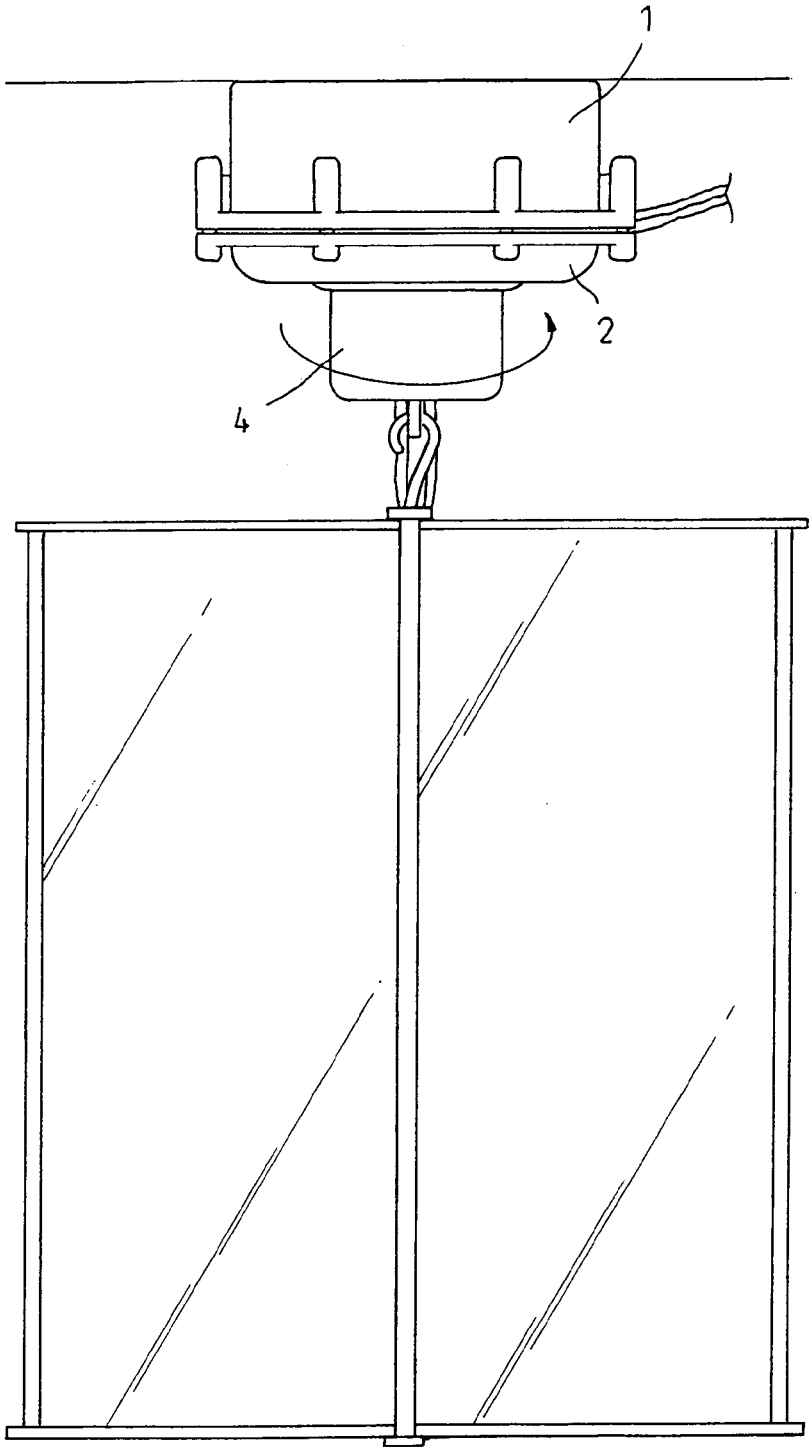
FIG. 5 is a plan view showing another embodiment connecting with a lantern according to the present invention.

As shown in FIG. 5, it is another embodiment of the present invention to hang a lantern, which is rotatable when lighting without difficulty. It is to be understood that other embodiments can be applied is use of the present rotatable power supply apparatus. Hence, the present invention obviously obtains improvement and should be allowed for a patent.

I claim:

1. A rotatable power supply apparatus for lighting ornaments comprising:

a housing including a motor and a frame;

the frame having an inner metal conducting circle and an outer metal conducting circle concentrically, and an aperture at a center of the inner and outer metal conducting circles; the inner and outer metal conducting circles of the frame electrically connecting to the motor and a plug by wires;

the motor having a shaft, the shaft passing upwardly through the aperture of the frame;

a housing cap mounted on the housing and having a central hole, the central hole of the housing cap receiving a connecting rotor and a rotor cover placed outside of the connecting rotor;

the connecting rotor having an inner shaft-joint engaged with the shaft of the motor, and having a first and a second downward metal pins;

wherein, lower ends of the first and second downward metal pins are contacted to the inner and outer metal conducting circles of the frame respectively;

wherein, upper ends of the first and second downward metal pins are connected to electrical wires; the electrical wires extending upwardly, penetrating through a rotor brushing and connected to a socket; and the rotor brushing positioned at an upper end of the connecting rotor and received in a hole of the rotor cover.

2. The rotatable power supply apparatus as claimed in claim 1, wherein the rotor cover is connected with the lighting ornaments, and the socket is engaged with a plug of a light string wound on the ornaments.

* * * * *